US009937372B2

(12) United States Patent
Brown

(10) Patent No.: US 9,937,372 B2
(45) Date of Patent: Apr. 10, 2018

(54) EXERCISE DEVICE AND METHOD

(71) Applicant: Adam S. Brown, Santa Barbara, CA (US)

(72) Inventor: Adam S. Brown, Santa Barbara, CA (US)

( * ) Notice: Subject to any disclaimer, the term of this patent is extended or adjusted under 35 U.S.C. 154(b) by 76 days.

(21) Appl. No.: 14/925,109

(22) Filed: Oct. 28, 2015

(65) Prior Publication Data

US 2016/0129293 A1 May 12, 2016

Related U.S. Application Data

(60) Provisional application No. 62/076,027, filed on Nov. 6, 2014.

(51) Int. Cl.

| | |
|---|---|
| ***A63B 21/00*** | (2006.01) |
| ***A63B 21/04*** | (2006.01) |
| ***A63B 69/10*** | (2006.01) |
| ***A63B 21/055*** | (2006.01) |
| ***A63B 22/18*** | (2006.01) |
| ***A63B 22/20*** | (2006.01) |
| ***A63B 23/035*** | (2006.01) |

(52) U.S. Cl.

CPC .... *A63B 21/0442* (2013.01); *A63B 21/00072* (2013.01); *A63B 21/0557* (2013.01); *A63B 21/4011* (2015.10); *A63B 21/4013* (2015.10); *A63B 21/4019* (2015.10); *A63B 21/4021* (2015.10); *A63B 21/4031* (2015.10); *A63B 21/4035* (2015.10); *A63B 21/4043* (2015.10); *A63B 22/18* (2013.01); *A63B 22/203* (2013.01); *A63B 23/03541* (2013.01); *A63B 23/03575* (2013.01); *A63B 69/10* (2013.01); *A63B 2208/0257* (2013.01); *A63B 2225/09* (2013.01)

(58) Field of Classification Search

USPC ..... 482/1–148

See application file for complete search history.

(56) References Cited

U.S. PATENT DOCUMENTS

| | | | | |
|---|---|---|---|---|
| 4,422,634 | A * | 12/1983 | Hopkins | A63B 69/10 482/56 |
| 4,674,740 | A * | 6/1987 | Iams | A63B 69/10 482/111 |
| 4,830,363 | A * | 5/1989 | Kennedy | A63B 21/4033 434/254 |
| 5,234,394 | A * | 8/1993 | Wilkinson | A63B 21/055 482/121 |
| 5,261,864 | A | 11/1993 | Fitzpatrick | |

(Continued)

*Primary Examiner* — Stephen R Crow

(74) *Attorney, Agent, or Firm* — Roeder & Broder LLP; James P. Broder

(57) ABSTRACT

An exercise device for use by a user on a support surface comprises a support assembly, an extendable neck, and one or more resilient first resistance assemblies. The support assembly supports the user relative to the support surface. The support assembly includes a support body that is engaged by the user, and a support base that supports the support body, the support base resting on the support surface. The extendable neck is movably coupled to the support assembly. More particularly, the extendable neck is selectively movable relative to the support assembly between a retracted position and an extended position. The one or more resilient first resistance assemblies are secured to the extendable neck.

20 Claims, 6 Drawing Sheets

(56) References Cited

U.S. PATENT DOCUMENTS

| | | | | |
|---|---|---|---|---|
| 5,354,251 | A * | 10/1994 | Sleamaker | A63B 21/156 482/142 |
| 5,542,898 | A * | 8/1996 | Wilkinson | A63B 21/0552 482/120 |
| 5,688,210 | A | 11/1997 | Chou | |
| 6,220,994 | B1 | 4/2001 | Rich | |
| 6,245,001 | B1 | 6/2001 | Siaperas | |
| 7,104,931 | B2 | 9/2006 | Saul | |
| 7,591,763 | B1 * | 9/2009 | Fucci | A63B 21/0552 482/121 |
| 7,635,323 | B2 * | 12/2009 | Halbridge | A63B 21/026 482/121 |
| 8,012,071 | B2 * | 9/2011 | Grisdale | A63B 21/0004 482/122 |
| 8,029,425 | B2 | 10/2011 | Bronson et al. | |
| 8,550,967 | B2 * | 10/2013 | Zuckerman | A63B 69/10 482/142 |
| 8,876,676 | B2 * | 11/2014 | Lalaoua | A63B 71/023 482/123 |
| 2006/0142129 | A1 * | 6/2006 | Siaperas | A63B 21/04 482/142 |
| 2007/0129226 | A1 | 6/2007 | Leavitt | |
| 2008/0119338 | A1 * | 5/2008 | Prsala | A63B 21/0552 482/142 |
| 2013/0203569 | A1 * | 8/2013 | Athis | A63B 21/0552 482/142 |
| 2014/0315171 | A1 * | 10/2014 | Tsai | A63B 69/10 434/254 |
| 2015/0141210 | A1 | 5/2015 | Hall | |
| 2015/0141223 | A1 * | 5/2015 | Wood | A63B 22/16 482/146 |
| 2016/0129293 | A1 * | 5/2016 | Brown | A63B 21/0442 482/56 |
| 2017/0189783 | A1 * | 7/2017 | Woodrow | A63B 69/3641 |

* cited by examiner

EXERCISE DEVICE AND METHOD

RELATED APPLICATION

This application claims priority under 35 U.S.C. § 119(e) on U.S. Provisional Application Ser. No. 62/076,027, filed Nov. 6, 2014 and entitled "EXERCISE DEVICE AND METHOD". As far as permitted, the contents of U.S. Provisional Application Ser. No. 62/076,027 are incorporated herein by reference.

BACKGROUND

It has long been recognized that swimming is an excellent form of exercise. Swimming develops good muscle conditioning, exercises the cardiovascular system, is very low impact, and is one of the more effective exercises for burning calories and helping people control and/or reduce weight.

However, it is difficult for many people to participate in swimming on a regular basis for a wide variety of reasons. Owning a home pool can be expensive and difficult to maintain, not to mention geographic and/or meteorological considerations that may render a pool unusable for half the year or more. Additionally, the space requirements for owning a pool (and/or a separate workout room) can be excessive. Memberships to health clubs and fitness centers can be expensive. Many people are self-conscious about their bodies and will avoid going to a public pool. Further, many public pools can also lack cleanliness or are poorly maintained. Moreover, the time involved to travel to a facility with a pool or to a natural body of water can be prohibitive for many people.

SUMMARY

The present invention is directed toward an exercise device that provides a user with some or all of the beneficial effects of swimming without having to enter the water. The exercise device is compact, portable and usable in a person's home, while travelling, or while in a fitness facility. The exercise device also provides the advantages of the user being able to engage in numerous non-aquatic exercises as well, or in the alternative.

The present invention is directed toward an exercise device for use by a user on a support surface. In various embodiments, the exercise device comprises a support assembly, an extendable neck, and one or more resilient first resistance assemblies. The support assembly supports the user relative to the support surface. In some embodiments, the support assembly includes a support body that is engaged by the user, and a support base that supports the support body, the support base resting on the support surface. The extendable neck can be movably coupled to the support assembly. More particularly, the extendable neck can be selectively movable relative to the support assembly between a retracted position and an extended position. The one or more resilient first resistance assemblies can be secured to the extendable neck.

In various applications, the exercise device functions with the user lying on top of the support body, e.g., in a supine position. The support body can be coupled to the top of the support base. By having the user lay on their back, facing upward, the problem of having sufficient space for full range of motion to simulate all major swimming strokes is alleviated. In addition, the upward facing position engages the core which helps improve total body functional fitness.

In some embodiments, the extendable neck is movable along an axis that is substantially parallel to the support surface. Alternatively, in other embodiments, when the extendable neck is in the extended position, the extendable neck extends away from the support assembly at a neck angle of between five degrees and thirty-five degrees relative to the support surface.

Additionally, the exercise device can further comprise a handle that is coupled to a distal end of the extendable neck. This can assist the user in the portability of the exercise device. Moreover, in one embodiment, the exercise device can include wheels that are coupled to the bottom of the support base. By pulling on the handle, the user can manipulate the position of the exercise so that only the wheels are in contact with the support surface, which will further enhance the portability of the exercise device.

In some embodiments, the support body includes a single body member that supports the user during use of the exercise device. Alternatively, the support body can include two spaced apart body members that support the user during use of the exercise device.

Further, the support base can define a base cavity therein. The base cavity can be utilized for storage of any desirable items. For example, the user can store the first resistance assemblies within the base cavity when not in use. Further, the user can store towels, mats or any other chosen items within the base cavity. In various embodiments, the support assembly includes a first end and an opposed second end, wherein the extendable neck is movably coupled to a first end of the support assembly. In some embodiments, the exercise device further comprises one or more resilient second resistance assemblies that are secured to the second end of the support assembly. For example, in one embodiment, two resilient first resistance assemblies are secured to the extendable neck, the two resilient first resistance assemblies being configured to engage the hands of the user; and two resilient second resistance assemblies are secured to the second end of the support assembly, the two resilient second resistance assemblies being configured to engage the feet of the user. In alternative embodiments, the two resilient second resistance assemblies can be secured together to the second end of the support assembly. Alternatively, the two resilient second resistance assemblies can be secured spaced apart from one another to the second end of the support assembly. The exercise device can further comprise a tension adjuster that is coupled to the one or more resilient second resistance assemblies to selectively adjust the tension within the second resistance assemblies.

In certain embodiments, the support base includes a leg assembly that is selectively movable between an upright configuration and a collapsed configuration.

Additionally, in some embodiments, the extendable neck is selectively movable relative to the support assembly between the retracted position and a plurality of extended positions. Moreover, the extendable neck can be locked in such positions.

Further, in certain embodiments, the support body includes a self-inflating air pad.

The present invention is further directed toward a method for exercising by a user, the method comprising positioning the user on the exercise device as described above, and the user pulling on the first resistance assemblies to increase tension in the first resistance assemblies.

DESCRIPTION

Embodiments of the present invention are described herein in the context of an exercise device and method. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1A:
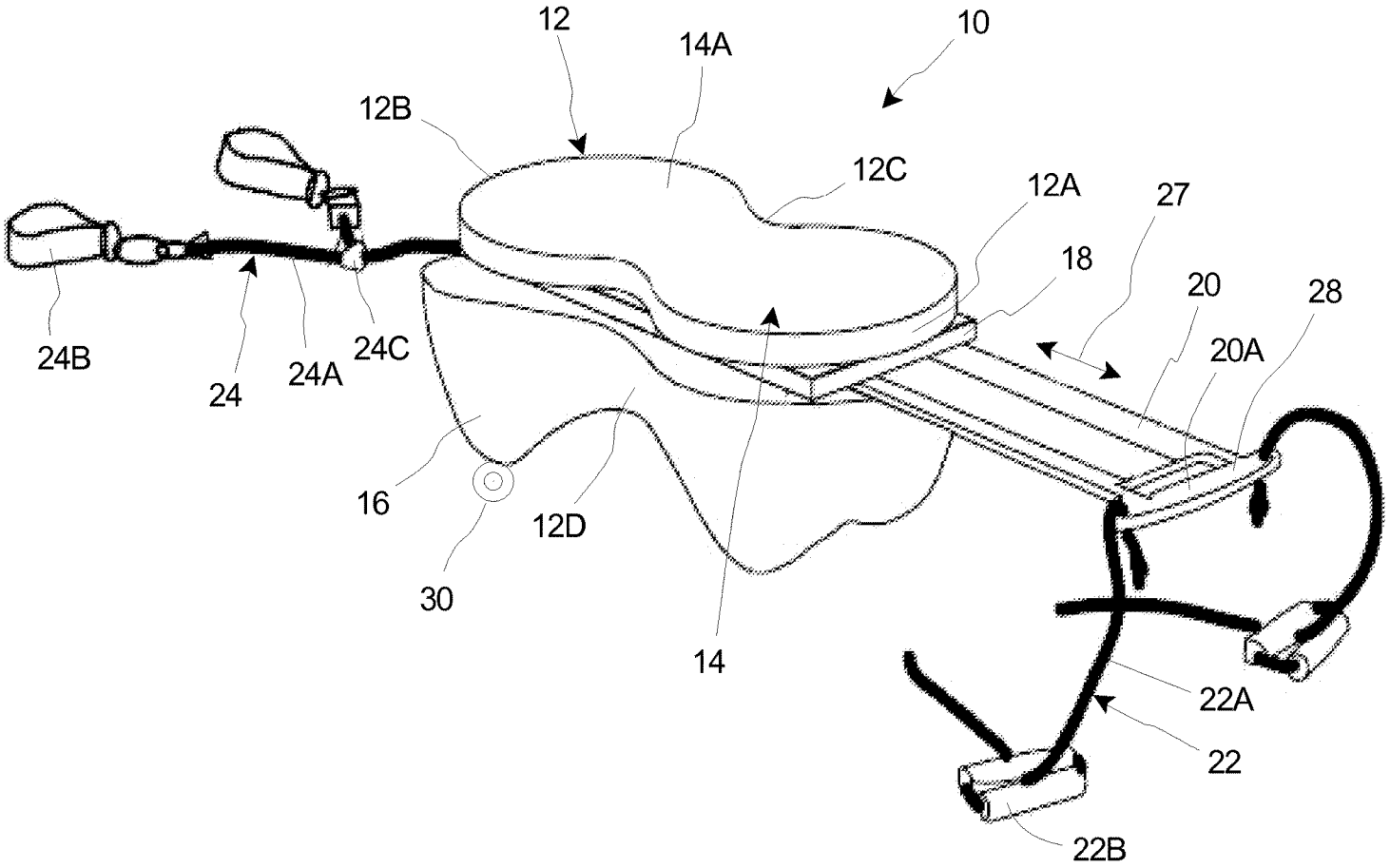
FIG. 1A is a perspective view illustration of one embodiment of an exercise device having features of the present invention.

FIG. 1A is a perspective view illustration of an embodiment of an exercise device 10 having features of the present invention. As described in detail herein, the exercise device 10 allows a user 11 (illustrated as a simplified stick figure in FIG. 1E) to simulate various swimming strokes, including the intricate arm movements as well as the associated kicks. The exercise device 10 is able to provide such stroke simulation while not requiring the user 11 to ever enter water. Additionally, the exercise device 10 can also be utilized by the user 11 to perform various other non-swimming-related exercises. Moreover, the exercise device 10 is compact and portable, and thus can be used in a person's home, while travelling, or in a fitness facility.

The design of the exercise device 10 can be varied. As shown in FIG. 1A, in certain embodiments, the exercise device 10 includes a support assembly 12 including a support body 14, a support base 16 and a support plate 18; an extendable neck 20 that is movably coupled to the support assembly 12; one or more resilient first resistance assemblies 22; and one or more resilient second resistance assemblies 24. Alternatively, the exercise device 10 can include more components or fewer components than those specifically illustrated in FIG. 1A. For example, in some non-exclusive alternative embodiments, the support assembly 12 can be designed without the support plate 18, and/or the exercise device 10 can be designed without the first resistance assemblies 22 and/or without the second resistance assemblies 24.

The support assembly 12 is configured to support the user 11 above a support surface 26 (illustrated, for example, in FIG. 1D, and also referred to herein simply as a "surface"), such as a floor or the ground. The design of the support assembly 12 can be varied to suit the specific requirements of the exercise device 10 and/or to suit the needs or desires of the user 11. As noted above, in this embodiment, the support assembly 12 includes the support body 14, the support base 16 and the support plate 18. Additionally, as shown in FIG. 1A, the support assembly 12 can be said to include a first end 12A, an opposed second end 12B, a first side 12C and an opposed second side 12D. It should be understood that the labeling of the first end 12A, the second end 12B, the first side 12C and the second side 12D is merely for convenience and ease of description and is not intended to be limiting in any manner.

The support body 14 is configured to provide a comfortable support for the user 11 as the user 11 uses the exercise device 10. The support body 14 can have any suitable design and can be made from any suitable materials. For example, in certain non-exclusive embodiments, the support body 14 can be inflatable (e.g., can include one or more self-inflating air pads), can include a foam or plastic material, or can include some other suitable type of comfortable pad. Additionally, the support body 14 can have any suitable shape that effectively supports the torso of the user 11. For example, as shown in FIG. 1A, the support body 14 includes a single body member 14A that is in the general shape of a figure eight. Alternatively, in one non-exclusive alternative embodiment, the support body 14 can include two body members that are substantially circular in shape. Still alternatively, the support body 14 can include any suitable number of body members and the support body 14 can be of any suitable shape.

The support base 16 can be positioned on the support surface 26 to support the support body 14 and thus the user 11 relative to the support surface 26. Thus, the user 11 is effectively raised above the support surface 26 during use of the exercise device 10. The support base 16 can have any suitable shape and can be formed from any suitable materials. For example, as shown in FIG. 1A, the support base 16 can have a substantially figure eight-shaped cross-section, and can have multiple discrete contact points with the support surface 26. Alternatively, the support base 16 can have another suitable cross-sectional shape, such as a circular-shaped cross-section, a rectangular-shaped cross-section, or another suitable cross-sectional shape, which can be provided for functional as well as aesthetic purposes. Still alternatively, in other non-exclusive embodiments, the support base 16 can be in the form of one or more legs, which may or may not be adjustable in order to selectively adjust the height of the support body 14 above the support surface 26. Additionally, in some embodiments, the support base 16 can be formed from rigid plastic, wood, composites, or any other suitable materials, or any combination thereof.

As shown, the support plate 18 can be positioned substantially between the support body 14 and the support base 16 and can provide additional support for the user 11 of the exercise device 10. Additionally, in some embodiments, the support plate 18 can provide a means for movably coupling the extendable neck 20 to the support assembly 12. In one embodiment, as shown, the support plate 18 can be substantially rectangle-shaped, although other suitable shapes can also be used for the support plate 18. Alternatively, the support assembly 12 can be designed without the support plate 18.

The extendable neck 20 is movably, e.g., hingedly, slidingly or telescopingly, coupled to the support assembly 12, i.e. at or near the first end 12A of the support assembly 12. More specifically, in some embodiments, the extendable neck 20 can be movably coupled to one or more of the support body 14, the support base 16 and the support plate 18. For example, in one such embodiment, the extendable neck 20 is movably coupled to the support plate 18. Alternatively, the extendable neck 20 can be coupled to another type of bracket (not shown) that is attached to the support base 16 below the support body 14. It should be appreciated that the extendable neck 20 can be coupled to the support assembly 12 in any suitable manner.

Figure 1B:
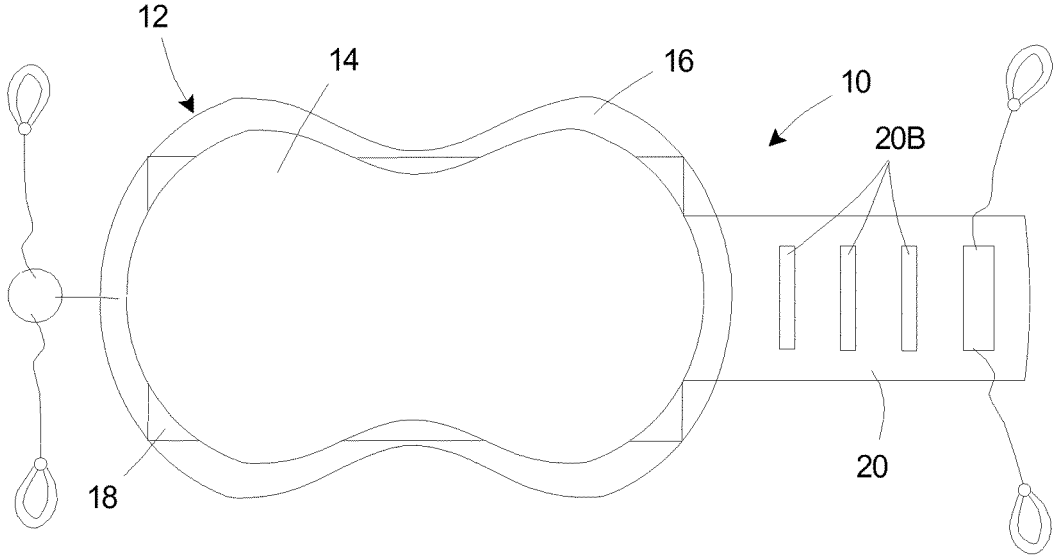
FIG. 1B is a simplified top view illustration of the exercise device in FIG. 1A, the exercise device including an extendable neck that is in an extended position.
Figure 1C:
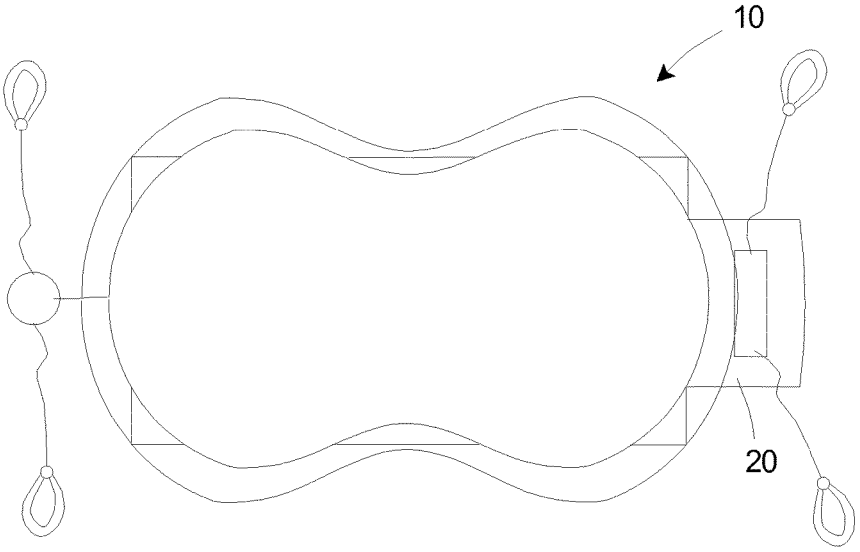
FIG. 1C is a simplified top view illustration of the exercise device in FIG. 1A, with the extendable neck in a retracted position.
Figure 1D:
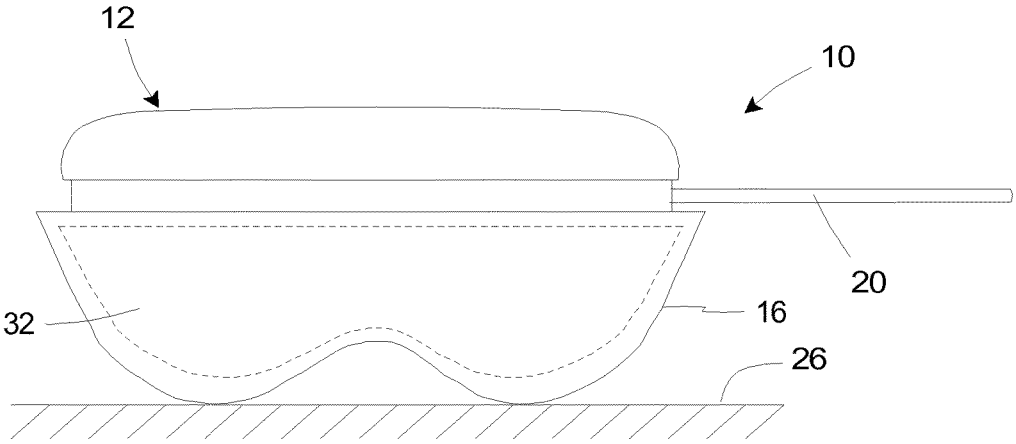
FIG. 1D is a simplified side view illustration of the exercise device in FIG. 1A, with the extendable neck in the extended position.

Additionally, as provided herein, the extendable neck 20 is selectively movable between a retracted position (shown, for example, in FIGS. 1C and 1E) and a fully extended position (shown, for example, in FIGS. 1A, 1B and 1D). In the fully extended position, as shown in FIG. 1A, the extendable neck 20 extends and/or cantilevers away from the support assembly 12, i.e. away from the first end 12A of the support assembly 12. Moreover, in certain embodiments, the extendable neck 20 can be selectively moved to one or more partially extended positions between the retracted position and the fully extended position. More specifically, in such embodiments, the extendable neck 20 can be moved to and selectively fixed in one or more discrete partially extended positions and/or the extendable neck 20 can be moved and secured at any desired position along a continuum between the retracted position and the fully extended position. Further, in some embodiments, the extendable neck 20 can include a locking mechanism (not shown) that can releasably lock the extendable neck 20 into the noted positions relative to the support assembly 12.

In one embodiment, the extendable neck 20 can be partially or fully extended relative to the support assembly 12 to allow a full range of motion for the user's arms and sufficient resistance during a user's downstroke to mimic the forces involved while swimming in water. The extendable neck 20 can also be used as a head rest to reduce stress and/or strain on the user's neck.

As shown, the movement of the extendable neck 20 relative to the support assembly 12 can be along an axis (shown by arrow 27). In certain embodiments, the axis 27 can be substantially parallel to the support surface 26. Alternatively, the axis 27 can be at an angle (i.e. other than parallel) relative to the support surface 26. For example, in some such alternative embodiments, the extendable neck 20 can move relative to the support assembly 12 along an axis 27 that angles generally upward away from the support assembly 12. In other such alternative embodiments, the extendable neck 20 can move relative to the support assembly 12 along an axis 27 that angles generally downward away from the support assembly 12.

Additionally, in certain embodiments, as shown in FIG. 1A, a handle 28 can be coupled to and/or incorporated into the extendable neck 20. The handle 28 can be utilized to assist in the portability of the exercise device 10. For example, in some such embodiments, the exercise device 10 can further include one or more wheels 30 (only one is shown in FIG. 1A) that are coupled to the support base 16. Thus, when it is desired to move the exercise device 10 from one location to another, the user 11 can extend the neck 20 as desired and grasp the handle 28 and tilt the exercise device 10 so that only the wheels 30 are in contact with the support surface 26. It is relatively easy for the user 11 to then pull, i.e. roll, the exercise device 10 along the support surface 26 to another desired location. It should also be appreciated that the handle 28 can be used to lift the exercise device 10 off of the support surface 26 in moving the exercise device 10 from on location to another.

In the embodiment illustrated in FIG. 1A, the first resistance assemblies 22 are selectively coupled to the extendable neck 20 at or near a distal end 20A of the extendable neck 20, e.g., at or near the handle 28. Additionally, in this embodiment, the exercise device 10 includes two first resistance assemblies 22 that are selectively coupled to the extendable neck 20. Alternatively, the exercise device 10 can include greater than two or fewer than two first resistance assemblies 22.

As illustrated, in certain embodiments, the first resistance assemblies 22 are configured to provide desired resistance during movement of the arms or hands of the user 11 during use of the exercise device 10. Moreover, in certain embodiments, the amount of tension or resistance provided by the first resistance assemblies 22 can be selectively adjusted by the user 11.

The design of the first resistance assemblies 22 can be varied to suit the specific requirements of the exercise device 10 and/or to suit the needs and comfort of the user 11. In the embodiment illustrated in FIG. 1A, each of the first resistance assemblies 22 includes a first resistance member 22A and a first resistance grip 22B.

The first resistance member 22A is configured to resiliently provide resistance during use of the first resistance assemblies 22. More particularly, the first resistance member 22A can be formed of an elastic material that stretches and contracts during use.

The first resistance grip 22B is secured to the first resistance member 22A. In certain applications, the first resistance grip 22B comes in the form of a handle or loop that can be gripped by a hand of the user 11. Accordingly, as the user 11 engages in various exercises, e.g., various swimming simulation exercises, the user 11 can use his/her hand to grip and hold onto the first resistance grip 22B and thus stretch the first resistance member 22A in any desired manner.

It is appreciated that inclusion of two first resistance assemblies 22 as illustrated in FIG. 1A enables the user 11 to use one first resistance assembly 22 with each hand or arm. Additionally, it is further appreciated that when the exercise device 10 is utilized with the extendable neck 20 in the retracted position, the first resistance assemblies 22 can be positioned near the first end 22A of the support assembly 12. Further, it is also appreciated that when the exercise device 10 is not in use or when the first resistance assemblies 22 are not needed by the user 11, the first resistance assemblies 22 can be uncoupled from the extendable neck 20.

Additionally, in the embodiment illustrated in FIG. 1A, the second resistance assemblies 24 are selectively coupled to the support assembly 12 at or near the second end 12B of the support assembly 12. In this embodiment, the exercise device 10 includes two second resistance assemblies 24 that can be selectively coupled to the support assembly 12 at or near the second end 12B of the support assembly 12. More specifically, in this embodiment, the two second resistance assemblies 24 are coupled together to the support assembly 12 at a single location at or near the second end 12B of the support assembly 12. Alternatively, the exercise device 10 can include greater than two or fewer than two second resistance assemblies 24. Still alternatively, each of the second resistance assemblies 24 can be selectively coupled separately to the support assembly 12.

As illustrated, in certain embodiments, the second resistance assemblies 24 are configured to provide desired resistance during movement of the legs or feet of the user 11 during use of the exercise device 10. The design of the second resistance assemblies 24 can be varied to suit the specific requirements of the exercise device 10 and/or to suit the needs and comfort of the user 11. In the embodiment illustrated in FIG. 1A, each of the second resistance assemblies 24 includes a second resistance member 24A and a second resistance grip 24B.

The second resistance member 24A is configured to resiliently provide resistance during use of the second resistance assemblies 24. More particularly, the second resistance member 24A can be formed of an elastic material that stretches and contracts during use.

The second resistance grip 24B is secured to the second resistance member 24A. In certain applications, the second resistance grip 24B comes in the form of a loop that can be selectively engaged by a leg or foot of the user 11. Accordingly, as the user 11 engages in various exercises, e.g., various swimming simulation exercises, the user 11 can engage the second resistance grip 24B by fitting the second resistance grip 24B about his/her foot or leg, and thus stretch the second resistance member 24A in any desired manner. Alternatively, in other non-swimming-related exercises, the second resistance assemblies 24 can be used with the arms or hands of the user 11.

It should be appreciated that the inclusion of two second resistance assemblies 24 as illustrated in FIG. 1A enables the user 11 to use one second resistance assembly 24 with each foot or leg. Additionally, it should also be appreciated that when the exercise device 10 is not in use or when the second resistance assemblies 24 are not needed by the user 11, the second resistance assemblies 24 can be uncoupled from the support assembly 12.

As shown, the second resistance assemblies 24 can further include a tension adjuster 24C. The tension adjuster 24C, which can be an adjustable sliding clamp in one embodiment, can be employed to improve the functionality by adjusting the length and effective resistance initiation point of the second resistance members 24A to correspond to the various kicks involved in different swimming strokes. Thus, the tension adjuster 24C allows for full adjustment of the tension of the second resistance members 2 to mimic different aquatic resistances, as well as different swimming strokes.

It is appreciated that the use of the terms "first resistance assembly", "first resistance member", "first resistance grip", "second resistance assembly", "second resistance member", and "second resistance grip" is merely for purposes of convenience and ease of description. The use of such terms can thus be freely exchangeable, i.e. any given resistance assembly, resistance member or resistance grip can be a "first" or "second", and is not intended to be limiting in any manner.

As provided herein, with two first resistance assemblies 22 and two second resistance assemblies 24 being selectively coupled to the support assembly 12, the user 11 can simulate engaging in various swimming strokes by lying down on top of the support body 14. In certain applications, the user 11 lies face up on the support body 14 and connects his/her hands to the first resistance assemblies 22 and connects his/her feet to the second resistance assemblies 24. Accordingly, as the user 11 moves through the motions of the various swimming strokes, the first resistance assemblies 22 can provide resistance for the arms of the user 11 substantially similar to what would be experienced during arm strokes while swimming in water, and the second resistance assemblies 24 can provide resistance for the legs of the user 11 substantially similar to what would be experienced during leg kicks while swimming in water. Additionally, with the design as described in detail herein, the exercise device 10 permits the user 11 to engage either his/her arms or legs separately to focus on those muscle groups or both simultaneously for an entire body workout.

FIG. 1B is a simplified top view illustration of the exercise device 10 in FIG. 1A. More particularly, FIG. 1B illustrates the exercise device 10 with the extendable neck 20 being in the fully extended position. FIG. 1B also illustrates one potential shape and design for the support assembly 12, i.e. for the support body 14, the support base 16 and the support plate 18.

Additionally, as shown in FIG. 1B, in some embodiments, the extendable neck 20 can include a plurality of neck apertures 20B that better enable the positioning of the extendable neck 20 in partially extended positions.

FIG. 1C is another simplified top view illustration of the exercise device 10 in FIG. 1A. In particular, FIG. 1C illustrates the exercise device 10 with the extendable neck 20 in the retracted position.

FIG. 1D is a simplified side view illustration of the exercise device 10 in FIG. 1A, with the extendable neck 20 in the fully extended position. FIG. 1D also illustrates certain features and aspects of the shape and design of the support assembly 12 in this particular embodiment. Additionally, as noted above, FIG. 1D also illustrates the presence of the support surface 26 upon which the exercise device 10 may be used. The first resistance assemblies 22 and the second resistance assemblies 24 have been omitted from FIG. 1D for purposes of clarity.

Further, FIG. 1D also illustrates that the support base 16 can define a base cavity 32 (illustrated in phantom) that can be utilized as a storage cavity. For example, the base cavity 32 can be used to store the first resistance assemblies 22 (shown, for example, in FIG. 1A) and the second resistance assemblies 24 (shown, for example, in FIG. 1A) when they are not being used. Additionally, the base cavity 32 can be used to store other items such as towels, mats, or any other items that the user 11 (illustrated in FIG. 1E) wants to store within the base cavity 32. To access the base cavity 32, the support base 16 can include a closable door (not shown) or another suitable type of opening.

Figure 1E:
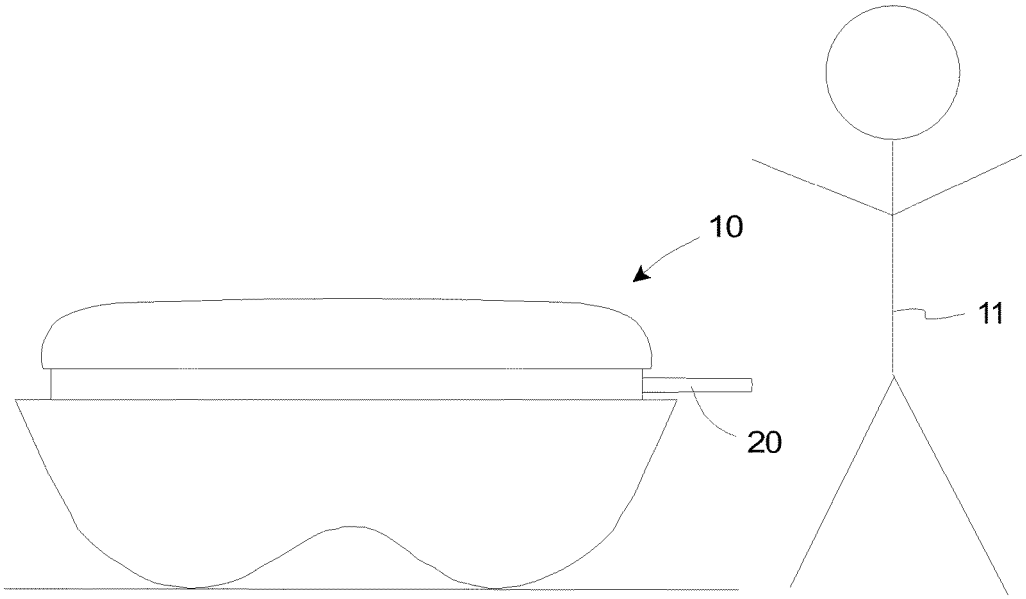
FIG. 1E is a simplified side view illustration of the exercise device in FIG. 1A, with the extendable neck in the retracted position.

FIG. 1E is another simplified side view illustration of the exercise device 10 in FIG. 1A, with the extendable neck 20 in the retracted position. The first resistance assemblies 22 and the second resistance assemblies 24 have again been omitted from FIG. 1E for purposes of clarity.

Figure 2:
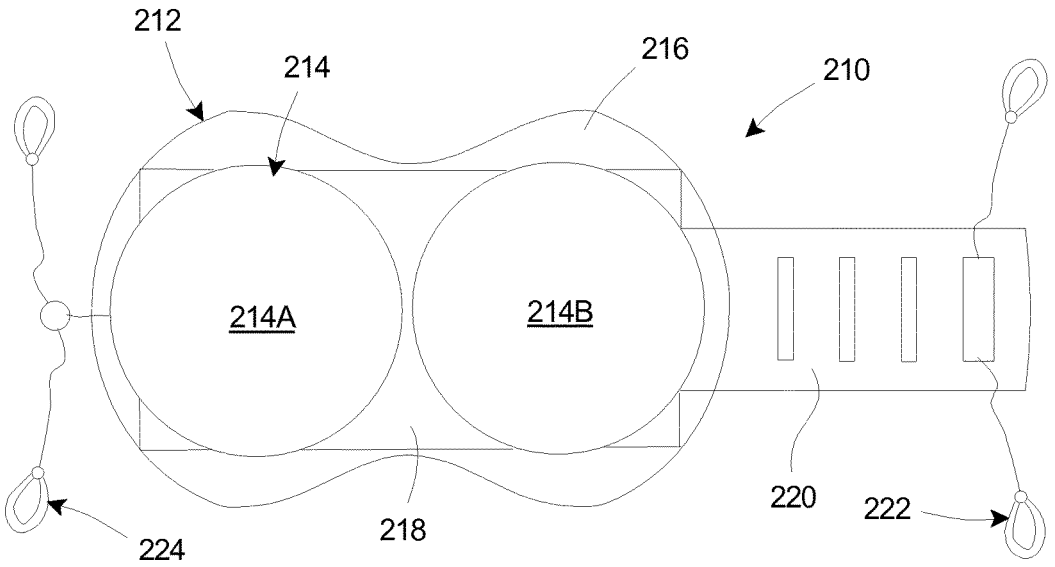
FIG. 2 is a simplified top view illustration of another embodiment of the exercise device.

FIG. 2 is a simplified top view illustration of another embodiment of the exercise device 210. The exercise device 210 illustrated in FIG. 2 is somewhat similar to the exercise device 10 illustrated and described above in relation to FIGS. 1A-1E. For example, the exercise device 210 again includes a support assembly 212 having a support body 214, a support base 216 and a support plate 218; an extendable neck 220; one or more first resistance assemblies 222; and one or more second resistance assemblies 224 that are somewhat similar in design and function to the corresponding components illustrated and described above.

However, in this embodiment, the design of the support body 214 is somewhat different than in the previous embodiment. More particularly, as shown, the support body 214 is formed from a pair of body members, i.e. a first body member 214A and a second body member 214B that are spaced apart from one another. Each of the body members 214A, 214B has a substantially circular-shaped cross-section. Alternatively, the body members 214A, 214B can have a different shape.

The body members 214A, 214B can be formed from any suitable materials. For example, as with the previous embodiment, the body members 214A, 214B can be inflatable, can include a foam or plastic material, or can include some other suitable type of comfortable pad.

Figure 3:
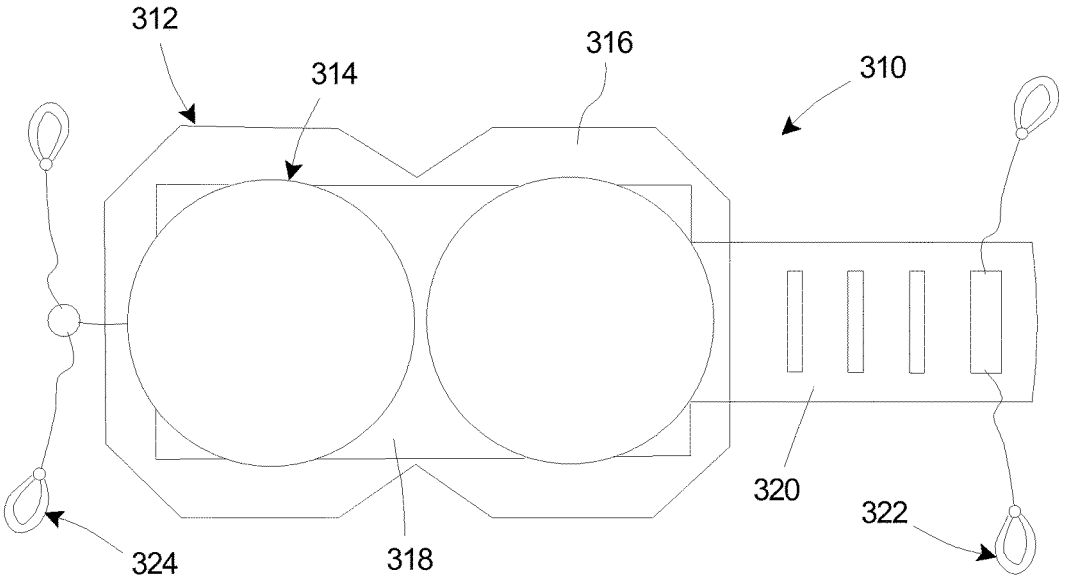
FIG. 3 is a simplified top view illustration of still another embodiment of the exercise device.

FIG. 3 is a simplified top view illustration of still another embodiment of the exercise device 310. The exercise device 310 illustrated in FIG. 3 is somewhat similar to those illustrated in the previous embodiments. For example, the exercise device 310 once again includes a support assembly 312 having a support body 314, a support base 316 and a support plate 318; an extendable neck 320; one or more first resistance assemblies 322; and one or more second resistance assemblies 324 that are somewhat similar in design and function to the corresponding components illustrated and described above.

However, in this embodiment, the design of the support base 316 is somewhat different than in the previous embodiments. More particularly, while the support base 316 is again designed with a somewhat figure eight shaped cross-section, the support base 316 includes a plurality of straight edges rather than the rounded edges that were shown in the previous embodiments.

Figure 4:
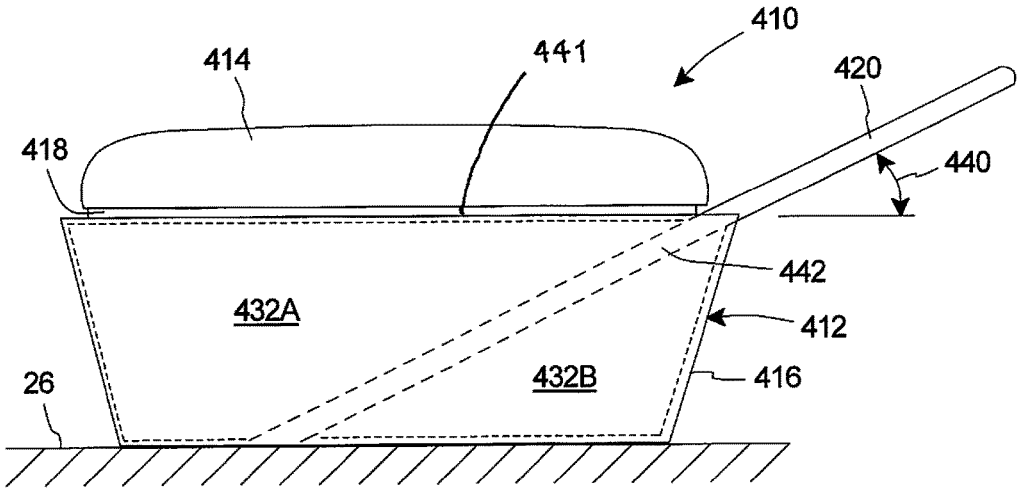
FIG. 4 is a simplified side view illustration of yet another embodiment of the exercise device.

FIG. 4 is a simplified side view illustration of yet another embodiment of the exercise device 410. The exercise device 410 illustrated in FIG. 4 again includes various components that were included in the previous embodiments. For example, the exercise device 410 again includes a support assembly 412 including a support body 414, a support base 416, and a support plate 418 that are somewhat similar to what was illustrated and described in relation to the previous embodiments.

However, in this embodiment, the support base 416 has a different shape than what was shown in the previous embodiments. In particular, as illustrated, the support base 416 can be substantially trapezoidal-shaped. Alternatively, the support base 416 can be substantially rectangular-shaped, square-shaped, or another suitable shape.

Additionally, in FIG. 4, the extendable neck 420 is coupled to the support assembly 412 such that the extendable neck 420 can extend and/or cantilever away from the support assembly 412 (i.e. when in the partially or fully extended position) at a neck angle 440 that is other than parallel to the support surface 26 and other than parallel to a top surface 441 of the support base 416. The neck angle 440 can be determined by what is anticipated to be the most comfortable position for the user 11 (illustrated in FIG. 1E). In some embodiments, the extendable neck 420 can extend and/or cantilever away from the support assembly 412 at a neck angle 440 of between approximately five degrees and thirty-five degrees. For example, in certain non-exclusive alternative embodiments, the extendable neck 420 can extend and/or cantilever away from the support assembly 412 at a neck angle 440 of approximately five degrees, ten degrees, fifteen degrees, twenty degrees, twenty-five degrees, thirty degrees, or thirty-five degrees. Alternatively, the neck angle 440 can be greater than thirty-five degrees and/or less than five degrees.

Further, as shown, the extendable neck 420 can be coupled to the support assembly 412 via a neck bracket 442 (illustrated in phantom) that extends into the support base 416. The extendable neck 420 can thus move, e.g., slide, relative to the neck bracket 442 between the retracted position and the fully extended position. As shown, the neck bracket 442 extends into the support base 416 at the same angle as the neck angle 440. Moreover, the neck bracket 442 can divide the interior of the support base 416 so as to define a first base cavity 432A (illustrated in phantom) and a second base cavity 432B (illustrated in phantom) that can each be used as a separate storage compartment.

It should be appreciated that in FIG. 4, the first resistance assemblies and the second resistance assemblies have been omitted for purposes of clarity.

Figure 5:
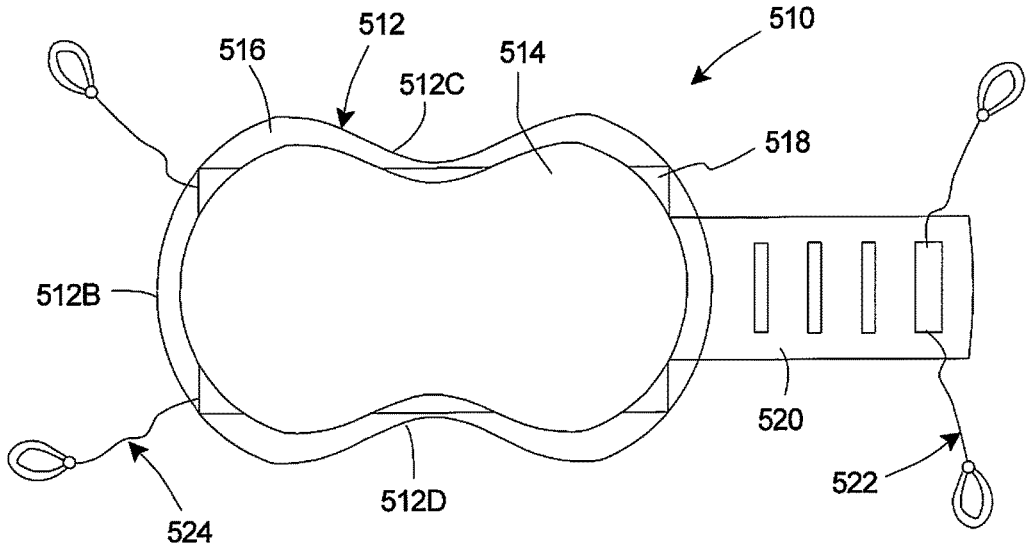
FIG. 5 is a simplified top view illustration of still another embodiment of the exercise device.

FIG. 5 is a simplified top view illustration of still another embodiment of the exercise device 510. As illustrated, the exercise device 510 shown in FIG. 5 is substantially similar to the exercise device 10 illustrated and described in relation to FIGS. 1A-1E. In particular, the exercise device 510 again comprises a support assembly 512 including a support body 514, a support base 514 and a support plate 518; an extendable neck 520; one or more first resistance assemblies 522; and one or more second resistance assemblies 524.

However, in this embodiment, the second resistance assemblies 524 are coupled to the support assembly 512 in a different manner. More specifically, each of the two second resistance assemblies 524 is selectively and individually coupled to the support assembly 512 near the second end 512B of the support assembly 512. For example, as shown, one second support assembly 524 can be selectively coupled near the second end 512B of the support assembly 512 near the first side 512C of the support assembly 512, and the other second resistance assembly 524 can be selectively coupled near the second end 512B of the support assembly 512 near the second side 512D of the support assembly 512. Alternatively, the second resistance assemblies 524 can be selectively coupled to the support assembly 512 in a different manner or in a different location.

Figure 6A:
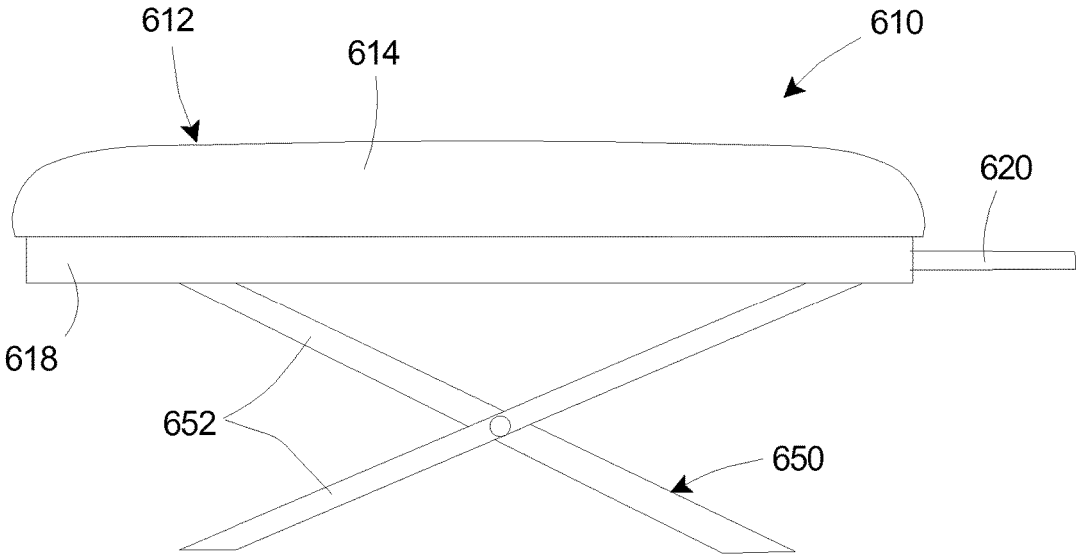
FIG. 6A is a simplified side view illustration of still yet another embodiment of the exercise device including a leg assembly positioned in an upright configuration.

FIG. 6A is a simplified side view illustration of still yet another embodiment of the exercise device 610. The exercise device 610 is again somewhat similar in design to the previous embodiments, including a support assembly 612 having a support body 614, a support base 616 and a support plate 618; and an extendable neck 620. The first resistance assemblies and the second resistance assemblies have been omitted for purposes of clarity.

Figure 6B:
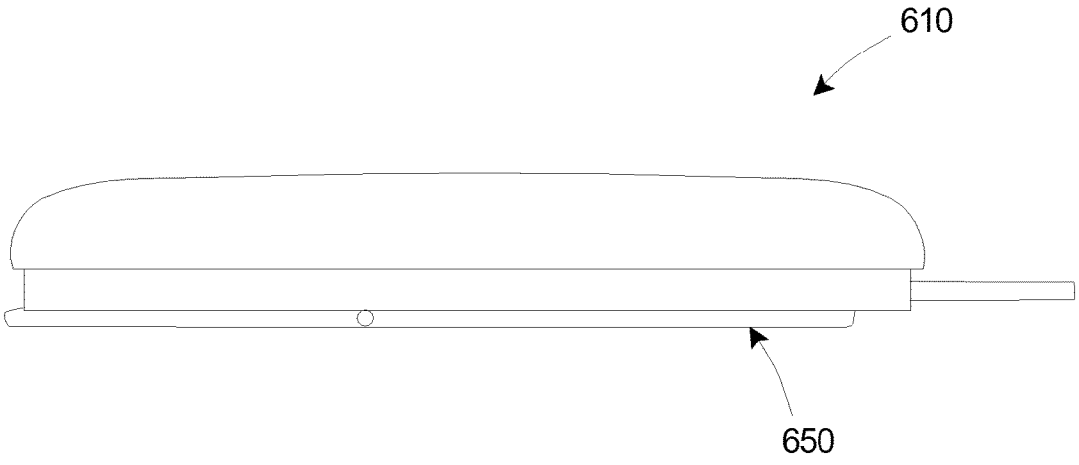
FIG. 6B is a simplified side view illustration of the exercise device in FIG. 6A, with the leg assembly shown in a collapsed configuration.

However, in FIG. 6A, the support base 616 has a different design than in the previous embodiments. More specifically, in this embodiment, the support base 616 of the support assembly 612 comprises a leg assembly 650 that can be selectively moved between an upright configuration (as shown in FIG. 6A) and a collapsed configuration (as shown in FIG. 6B). For example, the leg assembly 650 can include a pair of legs 652 that are movably coupled to one another, with at least one of the legs 652 being movably coupled to the support body 614 and/or the support plate 618. In such embodiment, the leg assembly 650 can function and move similar to the legs on a typical ironing board. Alternatively, the leg assembly 650 can include one or more legs that can move upward or downward telescopingly or by other suitable means to adjust a height of the support body 614 above the support surface 26 (illustrated in FIG. 1D).

FIG. 6B is a simplified side view illustration of the exercise device 610 of FIG. 6A, with the leg assembly 650 in the collapsed configuration.

In the various embodiments described in detail herein, the exercise device 10 can be suited to users 11 (illustrated in FIG. 1E) of all fitness and ability levels and ages. For example, by allowing the user 11 to select the type of swim stroke to use and whether to engage in the arm stroke, kick or both, the user 11 can custom tailor the exercise to his/her individual needs and fitness level. The swimming strokes that can be replicated using the exercise device 10 include, but are not limited to, the following: Freestyle, Breaststroke, Backstroke, Elementary Backstroke, Butterfly and Sidestroke. Additionally, by lying in a supine position while using the exercise device 10, the user 11 can more naturally engage their midsection which increases core strength and functional fitness.

In addition to the various swimming simulation exercises that can be performed using the exercise device 10, as noted above, the exercise device 10 can also function as an effective strength training device. For example, the support assembly 12 can equally or additionally be used as a general exercise bench and an aerobic step. With the extendable neck 20 in the retracted position, the resistance assemblies 22, 24 on both ends 12A, 12B of the support assembly 12 can be used for a wide variety of resistance exercises including bench press, curls, triceps extensions, shoulder press, lateral raises, squats, leg extensions, hip abduction and much more. Further, the exercise device 10 can also be used during Pilates exercises, such as use as a Pilates reformer.

It is understood that although a number of different embodiments of the exercise device 10 and method have been illustrated and described herein, one or more features of any one embodiment can be combined with one or more features of one or more of the other embodiment, provided that such combination satisfies the intent of the present invention.

While a number of exemplary aspects and embodiments of the exercise device 10 and method have been shown and disclosed herein above, those of skill in the art will recognize certain modifications, permutations, additions and sub-combinations thereof. It is therefore intended that the system and method shall be interpreted to include all such modifications, permutations, additions and sub-combinations as are within their true spirit and scope, and no limitations are intended to the details of construction or design herein shown.

What is claimed is:

1. An exercise device for use by a user on a support surface, the exercise device comprising:

a support assembly that supports the user relative to the support surface, the support assembly including a support body that is engaged by the user, and a support base that supports the support body, the support base resting on the support surface, the support base having a top surface;

an extendable neck that is movably coupled to the support assembly, the extendable neck being selectively movable relative to the support assembly between a retracted position and an extended position, wherein when the extendable neck is in the extended position, the extendable neck extends away from the support assembly at a neck angle of between five degrees and thirty-five degrees relative to the top surface; and one or more resilient first resistance assemblies that are secured to the extendable neck.

2. An exercise device for use by a user on a support surface, the exercise device comprising:

a support assembly that supports the user relative to the support surface, the support assembly including a support body that is engaged by the user, and a support base that supports the support body, the support base resting on the support surface, the support base having a top surface;

an extendable neck that is coupled to the support assembly, the extendable neck being movable relative to the support assembly between a retracted position and an extended position, the extendable neck being fixed relative to the support assembly when in the extended position, wherein when the extendable neck is in the extended position, the extendable neck extends away from the support assembly at an angle that is non-parallel relative to the top surface; and one or more resilient first resistance assemblies that are secured to the extendable neck.

3. An exercise device for use by a user on a support surface, the exercise device comprising:

a support assembly that supports the user relative to the support surface, the support assembly including a support body that is engaged by the user, and a support base that supports the support body, the support base resting on the support surface, the support base having a top surface;

an extendable neck that is coupled to the support assembly, the extendable neck being movable relative to the support assembly between a retracted position and an extended position, the extendable neck being fixed relative to the support assembly when in the extended position, wherein when the extendable neck is in the extended position, the extendable neck extends away from the support assembly at an angle that is non-parallel relative to the support surface and the top surface; and one or more resilient first resistance assemblies that are secured to the extendable neck.

4. The exercise device of claim 2 further comprising a handle that is coupled to a distal end of the extendable neck.

5. The exercise device of claim 2 wherein the support body includes a single body member that supports the user during use of the exercise device.

6. The exercise device of claim 2 wherein the support body includes two spaced apart body members that support the user during use of the exercise device.

7. The exercise device of claim 2 wherein the support base defines a base cavity therein.

8. The exercise device of claim 2 wherein the support assembly includes a first end and an opposed second end, wherein the extendable neck is movably coupled to the first end of the support assembly, and wherein the exercise device further comprises one or more resilient second resistance assemblies that are secured to the second end of the support assembly.

9. The exercise device of claim 8 wherein two resilient first resistance assemblies are secured to the extendable neck, the two resilient first resistance assemblies being configured to engage the hands of the user; and wherein two resilient second resistance assemblies are secured to the second end of the support assembly, the two resilient second resistance assemblies being configured to engage the feet of the user.

10. The exercise device of claim 9 wherein the two resilient second resistance assemblies are secured together to the second end of the support assembly.

11. The exercise device of claim 9 wherein the two resilient second resistance assemblies are secured spaced apart from one another to the second end of the support assembly.

12. The exercise device of claim 8 further comprising a tension adjuster that is coupled to the one or more resilient second resistance assemblies to selectively adjust the tension within the second resistance assemblies.

13. The exercise device of claim 2 wherein the support base includes a leg assembly that is selectively movable between an upright configuration and a collapsed configuration.

14. The exercise device of claim 2 wherein the extendable neck is selectively movable relative to the support assembly between the retracted position and a plurality of extended positions.

15. The exercise device of claim 2 wherein the support body includes a self-inflating air pad.

16. A method for exercising by a user, the method comprising positioning the user on the exercise device of claim 2, and the user pulling on the first resistance assemblies to increase tension in the first resistance assemblies.

17. The exercise device of claim 3 wherein the support assembly includes a first end and an opposed second end, wherein the extendable neck is coupled to the first end of the support assembly, and wherein the exercise device further comprises one or more resilient second resistance assemblies that are secured to the second end of the support assembly.

18. The exercise device of claim 17 wherein two resilient first resistance assemblies are secured to the extendable neck, the two resilient first resistance assemblies being configured to engage the hands of the user; and wherein two resilient second resistance assemblies are secured to the second end of the support assembly, the two resilient second resistance assemblies being configured to engage the feet of the user.

19. The exercise device of claim 3 further comprising a handle that is coupled to a distal end of the extendable neck.

20. A method for exercising by a user, the method comprising the steps of positioning the user on the exercise device of claim 18, and the user pulling on at least one of the first resistance assemblies and the second resistance assemblies to increase tension in the at least one of the first resistance assemblies and the second resistance assemblies.

* * * * *